US006553885B2

(12) United States Patent
Cole et al.

(10) Patent No.: US 6,553,885 B2
(45) Date of Patent: Apr. 29, 2003

(54) KNIFE BLADE FOR CUTTING FOOD PRODUCTS

(75) Inventors: Eugene H. Cole, Valparaiso, IN (US); Charles E. Rowell, Valparaiso, IN (US)

(73) Assignee: Urschel Laboratories, Inc., Valparaiso, IN (US)

( * ) Notice: Subject to any disclaimer, the term of this patent is extended or adjusted under 35 U.S.C. 154(b) by 43 days.

(21) Appl. No.: 09/846,453

(22) Filed: May 2, 2001

(65) Prior Publication Data

US 2001/0035082 A1 Nov. 1, 2001

Related U.S. Application Data

(60) Provisional application No. 60/201,290, filed on May 2, 2000.

(51) Int. Cl.[7] ..... B26D 1/00

(52) U.S. Cl. ..... 83/856; 83/402; 83/425.3; 83/662; 83/651; 83/432; 30/356

(58) Field of Search ..... 83/856, 932, 431, 83/440, 662, 858, 857, 694, 651, 531.1, 466.1, 468.1, 402, 425.3; 30/304, 165, 172, 279.2, 287, 346, 356, 351, 299, 169; 7/412, 381, 649

(56) References Cited

U.S. PATENT DOCUMENTS

| | | | | |
|---|---|---|---|---|
| D392,841 | S | | 3/1998 | Chastaine |
| 6,041,682 | A | * | 3/2000 | Jensen et al. ..... 83/13 |

* cited by examiner

*Primary Examiner*—Boyer D. Ashley
(74) *Attorney, Agent, or Firm*—Bacon & Thomas, PLLC

(57) ABSTRACT

A knife blade for cutting food products includes a cutting edge having a concave circular curved central portion and opposed linear end portions tangentially intersecting and extending away from opposite sides of the circular curved central portion. The shape of the cutting edge results in enhanced stability of the knife blade when slicing food products driven into the cutting edge and across the blade width.

4 Claims, 2 Drawing Sheets

KNIFE BLADE FOR CUTTING FOOD PRODUCTS

This application claims the benefit of provisional application no. 60/201,290 filed on May, 2, 2000.

BACKGROUND OF THE INVENTION

1. Field of the Invention

This invention relates to a knife blade for use in a commercial food slicing machine.

2. Related Art

This invention is a knife blade for use in a commercial slicing machine used to cut food products of the type described in U.S. Pat. No. 5,343,623 granted Sep. 6, 1994. FIG. 2 of the drawings of this description shows such a prior art knife blade 10 formed of a sheet metal stock and having apertures 12 at opposed end areas 14 of the blade. As described in the aforesaid U.S. Pat. No. 5,343,623, the blade includes a forward facing linear cutting edge 16 (the side that faces oncoming food products to be sliced) that extends parallel with a rear edge 18 over a portion of the length of the blade, the cutting edge 16 extending along an imaginary line connecting the center lines of apertures 12. The cutting edge 16 terminates at it's opposed ends at a wider area 20 of the blade 10 and the end areas 14 correspond with the full width of the generally rectangular blade 10. The end areas 14 are rigidly clamped in a blade holder as described in the aforesaid U.S. Pat. No. 5,343,623, such holder including transverse bolts (not shown) that extend through apertures 12 and, in cooperation with the clamping device, retain multiple identical knife blades 10 spaced adjacent and parallel to each other to cut food products into slices or strip shapes. Substantial tension is applied to the blade 10 through the clamping arrangement that secures the blades at their opposed end areas but more of the tension is actually applied through the apertures 12 via the transverse mounting bolts associated with the clamping device, all as described in the aforesaid U.S. Pat. No. 5,343,623.

The location of the cutting edge 16 along a line (or a transverse plane) connecting the center lines of the apertures 12 provided a distinct advantage in accordance with this prior art knife blade configuration due to the fact that the principal tension asserted on the blade was applied through the side walls of the apertures 12. The alignment of the cutting edge 16 with the centerlines of the apertures 12 placed the tension in the transverse plane including the cutting edge 16 which at the time the prior art invention was made was considered to be advantageous, for reasons described in U.S. Pat. No. 5,343,623.

Another prior art knife blade 22 suitable for use in a blade holder of the type described in U.S. Pat. No. 5,343,623 is shown in FIG. 1. This blade is described in U.S. Design Pat. No. 392,841 granted Mar. 31, 1998. The blade 22 is utilized in a hydraulic food cutter and is mounted in a holder generally similar to that described in U.S. Pat. No. 5,343, 623. This blade is formed with a cutting edge 24 on the front edge 25 that is defined by an arc of a circle having a radius $R_1$. The concave arc of the cutting edge extends into the blade width approximately up to an imaginary line 26 that tangentially approaches the outer diameters of apertures 28 located most closely adjacent the front edge of the blade and through which mounting bolts extend when the blade is mounted in a holder.

While the knife blades in accordance with the prior art functioned for their intended purposes, it is believed that the performance of such knife blades can be improved by using a better configuration of a cutting edge of the blades.

BRIEF DESCRIPTION OF THE INVENTION

This invention is constituted of a thin, planar generally rectangular knife blade constructed of sheet stock such as stainless steel including end areas each having a single fastener receiving aperture therein and configured to be clamped in a knife blade holder with other similar knife blades located adjacent to and extending parallel with each other to form a cutting array of knife blades.

The unique feature of the blade is the shape of the cutting edge at the front edge of the blade, namely a central circular concave curved portion terminating at tangentially extending opposed linear sections extending from opposite sides of the circular portion along the front edge of the blade up to the end areas thereof, where they intersect blade front edge portions extending (in this example) parallel with a line joining the center line of the apertures. The linear portions preferably extend up to a region where the blade end area is clamped in a holder.

The cutting edge of the blade is designed to simulate a tensioned wire supported at opposed ends at the blade clamping areas that is subjected to a transverse impact mid-length of the wire, which results in a knife blade that is remarkably stable during cutting of food products, particularly hard products, such as carrots and potatoes, and produces excellent slices of such products.

DETAILED DESCRIPTION OF THE PREFERRED EMBODIMENTS OF THE INVENTION

Figures 1, 2, 3, 4:
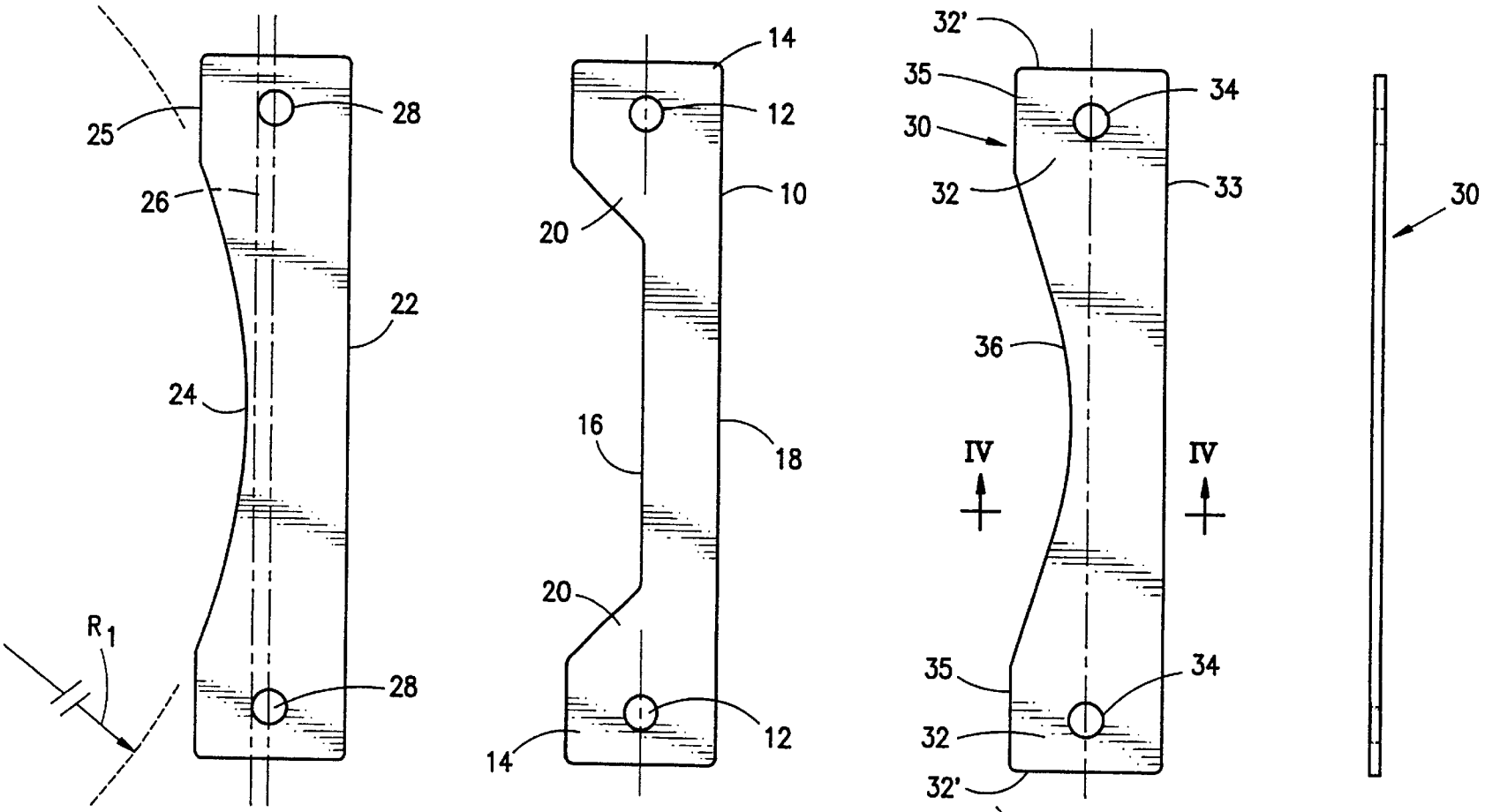
FIG. 2 PRIOR ART
FIG. 1 PRIOR ART
FIG. 1 shows a prior art knife blade for cutting food products.
FIG. 2 shows another prior art knife blade for cutting food products.
FIG. 3 shows side and rear elevation views of a knife blade constructed in accordance with the present invention.
FIG. 4 is a sectional view taken along line IV—IV in FIG. 3.

The knife blade 30 embodying the present invention is illustrated in FIGS. 3 and 4, wherein it can be seen that the knife blade is made of a generally rectangular body of relatively thin sheet stock such as stainless steel as described in U.S. Pat. No. 5,343,623. The knife blade 30 includes full width end areas 32 that are located inwardly of blade ends 32' and configured to be clamped in a knife blade holder of the type described in U.S. Pat. No. 5,343,623. Apertures 34 are provided in the end areas 32 approximately at the mid-point of the full width of the blade 30 extending between a rear edge 33 of the blade and non-cutting front edges 35 at the end areas 32.

A cutting edge 36 extends along the central portion of the front edge of the blade 30 between the end areas 32 and the non-cutting front edge portions 35. In this example, non-cutting front edge portions 35 extend parallel with rear edge 33, and the full width of the blade is defined by the distance between front edge portions 35 and rear edge 33. Non cutting front edge portions 35 and rear edge 33 both extend parallel to an imaginary line P connecting the centerlines of apertures 34.

The apertures 34 are intended to receive mounting bolts associated with a knife blade holder of the type described in U.S. Pat. No. 5,343,623 in association with other similar knife blades that extend adjacent to and parallel with each other to form an array of cutting blades suitable for slicing food products driven at high velocity against the cutting edges of the blades 36.

As shown in FIG. 4, the cutting edge 36 may be blunt and slightly rounded. It has been found that the cutting edges 36 of such blades need not be sharpened but may remain essentially rounded, such shape functioning quite well in view of the thin cross-section of the blades, as described in U.S. Pat. No. 5,343,623.

Figure 5:
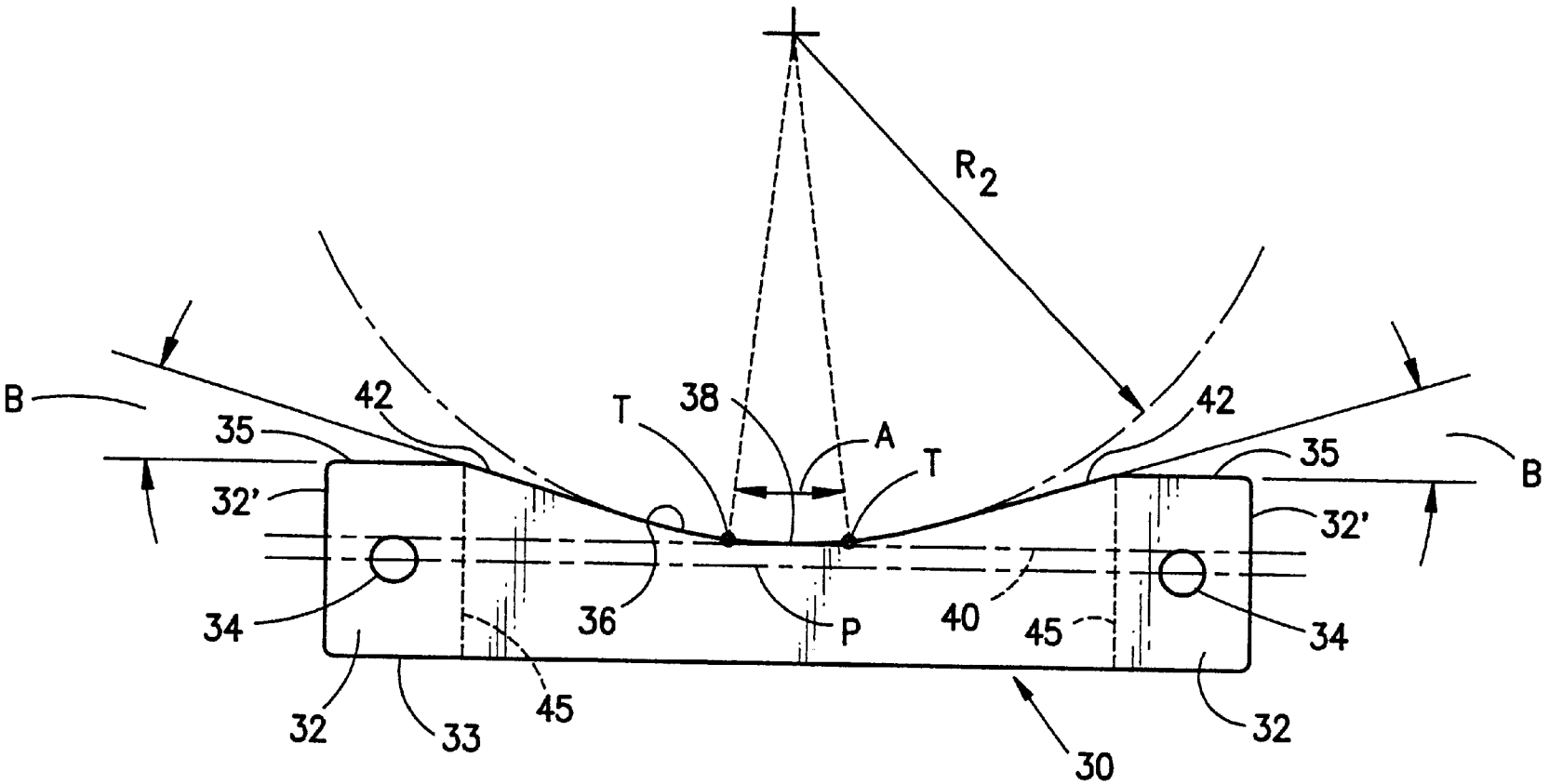
FIG. 5 illustrates the geometry of the cutting edge of the knife blade shown in FIG. 3.

The geometry of the cutting edge 36 of the blade 30 is depicted in more detail in FIG. 5. Specifically, the cutting edge 36 is formed to have a central concave circular curved central portion 38 defined by a segment A of a circle having a radius $R_2$ and which extends inwardly of the blade full width so as to be approximately tangent to an imaginary line 40 that extends parallel to line P and tangentially intersects the outer diameters of apertures 34 most closely adjacent the cutting edge side of the blades 30.

The central circular curved portion 38 tangentially intersects linear portions 42 of the cutting edge 36 that extend longitudinally away from central portion 38 along the blade 30 and intersect the front edge portions 35 of the blade 30 at the full width end areas 32. The end areas 32 terminate inwardly of the outer ends 32' of the blade 30 at imaginary lines 45 that are intended to depict the edge of a clamping device that receives the end areas 32 of the blade 30 when the blade is mounted in an array of knife blades to be used for slicing food products. It will be seen that the linear portions 42 of the cutting edge 36 intersect the front edge portions 35 of the blade 30 at the terminus of each end area 32 at an angle B that will be determined by the geometry of the cutting edge 36, including the radius $R_2$, and the arc defined by segment A of the central portion of the cutting edge 36. The intersection of linear portions 42 of the cutting edge with the front edge portion 35 of the blade preferably in this embodiment are at the intersection of the linear portions 42 with line 45, or the terminus of a clamp holding the blade end portions 32. The linear portions 42 also intersect the circular curved central portion 38 at points of tangency T.

When the blade 30 is tightly clamped in a holder extending over the end areas 32 with a mounting bolt (not shown) extending through apertures 34, cutting edge 36 comprising circular portion 38 and linear portions 42 will define a pair of straight lines tangentially intersecting a central concave circular arc defining the central portion 38 of the cutting edge 36. This shape approximates the shape a wire fixed at its opposed ends would assume when impacted by a generally round object at approximately mid-length of the wire. This shape has been found to produce high quality sliced food products due to enhanced stability of the knife blade 30 in the plane of the blade during slicing of food products driven against the blade cutting edge. That is, the cutting edge 36 assumes a shape that simulates a length of thin wire fixed at its ends at the intersection of the blade front edge portions 35 and lines 45 that is impacted with a generally round product at its mid-length.

Cutting wires of course, have been successfully used to slice food products in accordance with prior art technology. When the wire is struck by a food product to be sliced, the wire merely deforms in reaction to the impact of the food product while remaining in a single plane containing the wire and its end supports. It is theorized that the enhanced stability of the blade 30 constructed in accordance with the present invention results from forming the cutting edge 36 so that it emulates a cutting wire impacted by a rapidly moving food product to be sliced. This seems to reduce bonding of the blade rearwardly in the plane of the blade to thereby stabilize the blade during high speed slicing of food products driven into the cutting edge of the blade.

The invention is not to be limited to a knife blade having a specific circular radius $R_2$ or a specific length of arc defining the central portion 38. The cutting edge 36 may be dimensioned and configured in a manner that is somewhat different from that illustrated as an example of the invention. For example, the intersection of linear portions 42 of cutting edge 60 could be located more towards the curved central portion 38, in which case the radius $R_2$ would be smaller and the front edge portions 35 (which could be cutting edge portions) would be extended inwardly beyond line 45. The radius $R_2$ could be varied as well to thereby change the angle B where the linear portions 42 intersect the front edge portions 35. Various other changes to the overall configuration of the cutting blade 30 could be made without departing from the scope of the invention as defined in the claims to follow.

We claim:

1. A knife blade for cutting food products comprising:

an elongate knife blade body formed of metal sheet material configured in a generally rectangular shape, said body including opposed ends and opposed end areas adjacent said opposed ends adapted to be clamped in a knife blade holder, and a front edge extending between said opposed ends;

a single aperture having a side wall located in each end area;

a cutting edge extending along a central portion of the front edge of the body;

said cutting edge including a central circular concave curved portion, and opposed linear end portions tangentially intersecting the central circular concave curved portion at points of tangency at opposite ends of the curved portion, said linear end portions extending along the front edge of the body from said points of tangency towards the end areas of the body.

2. The knife blade as claimed in claim 1, wherein the curved central portion of the cutting edge extends inwardly of the blade body up to approximately an imaginary line extending between and tangent with said aperture side wall located closest to the front edge of the body.

3. The knife blade as claimed in claim 1, wherein said end areas each terminates inwardly of the body ends at predetermined distance from the body ends and said linear end portions extend to the terminus of said end areas at said predetermined distances from the body ends.

4. The knife blade as claimed in claim 2, wherein said end areas each terminates inwardly of the body ends at predetermined distance from the body ends and said linear portions extend to the terminus of said end areas at said predetermined distances from the body ends.

* * * * *